US012140364B2

(12) United States Patent
Bischof

(10) Patent No.: US 12,140,364 B2
(45) Date of Patent: Nov. 12, 2024

(54) MOBILE REFRIGERATOR HAVING BUILT-IN HANDLES

(71) Applicant: LEISURE-TEC INTERNATIONAL LIMITED, Harbour (HK)

(72) Inventor: Andreas Bischof, Harbor (HK)

(73) Assignee: LEISURE-TEC INTERNATIONAL LIMITED, Harbour (HK)

( * ) Notice: Subject to any disclaimer, the term of this patent is extended or adjusted under 35 U.S.C. 154(b) by 713 days.

(21) Appl. No.: 17/050,311

(22) PCT Filed: Apr. 25, 2019

(86) PCT No.: PCT/CN2019/084256
§ 371 (c)(1),
(2) Date: Oct. 23, 2020

(87) PCT Pub. No.: WO2019/206219
PCT Pub. Date: Oct. 31, 2019

(65) Prior Publication Data

US 2021/0055030 A1 Feb. 25, 2021

(30) Foreign Application Priority Data

Apr. 25, 2018 (CN) ..... 201820595364.2

(51) Int. Cl.
*F25D 11/00* (2006.01)
*B65D 25/28* (2006.01)

(52) U.S. Cl.
CPC ..... *F25D 11/003* (2013.01); *B65D 25/2852* (2013.01); *F25D 2300/00* (2013.01)

(58) Field of Classification Search
CPC ..... F25D 11/003; F25D 2300/00; F25D 2400/10; F25D 23/028; B65D 25/2852;
(Continued)

(56) References Cited

U.S. PATENT DOCUMENTS 3,464,586 A * 9/1969 Hitzeroth ..... A47J 45/065 220/763
5,068,944 A * 12/1991 Knurr ..... A45C 13/26 190/115

(Continued)

FOREIGN PATENT DOCUMENTS

CN 2520721 Y * 11/2002
CN 101614089 A 12/2009

(Continued)

*Primary Examiner* — Eugene G Byrd
*Assistant Examiner* — Jock Wong
(74) *Attorney, Agent, or Firm* — McNees Wallace & Nurick LLC

(57) ABSTRACT

A mobile refrigerator having built-in handles, comprising a box and handles. The side portions of the box are provided with recesses for accommodating the handles; each handle comprises a fixed base, a turnable handgrip, and two springs; the fixed base is connected to the box by bolts; the turnable handgrip is turnably connected to the fixed base by the two springs; the turnable handgrip comprises a grip, a first turning member, and a second turning member; the grip is connected to the first turning member and the second turning member separately by the bolts; the first turning member and the second turning member are turnably connected to the fixed base separately.

12 Claims, 2 Drawing Sheets

(58) Field of Classification Search
CPC .... B65D 25/32; B65D 25/28; B65D 25/2835; B65D 25/2838; B65D 25/2841; B65D 25/2844; B65D 25/2847; B65D 25/285; B65D 25/2855; B65D 25/2858; B65D 25/2861; B65D 25/2864; A45C 11/26; A45C 13/26; E05B 2001/0023; A45F 5/10; A47B 95/02; A47B 2095/022; B60N 3/02; B60N 3/023; B60N 3/026
USPC ..... 16/409, 428, 438, 444, 445; 220/762, 220/763, 761, 755, 766, 772
See application file for complete search history.

(56) References Cited

U.S. PATENT DOCUMENTS 5,160,075 A * 11/1992 Moscovitch ..... A63C 11/026 294/147
5,301,508 A * 4/1994 Kahl ..... F25B 21/02 220/592.2
5,319,937 A * 6/1994 Fritsch ..... F25B 21/04 62/3.62
5,400,470 A * 3/1995 Kammersgard ..... G06F 1/18 190/39
5,461,755 A * 10/1995 Hardigg ..... B65D 25/2841 220/759
6,230,925 B1 * 5/2001 Hardigg ..... B65D 25/2835 220/761
8,978,392 B2 * 3/2015 Blackway ..... F25B 21/02 62/3.62
2005/0066479 A1 * 3/2005 Kim ..... F25D 23/028 16/436
2006/0143865 A1 * 7/2006 Magyar ..... A47B 95/02 16/412
2008/0047097 A1 * 2/2008 Tsai ..... A45F 5/10 16/110.1
2008/0245096 A1 * 10/2008 Hanson ..... A45C 11/20 220/592.2
2012/0043342 A1 * 2/2012 Fjelland ..... B65D 25/2841 220/755
2017/0248362 A1 8/2017 Choo et al.

FOREIGN PATENT DOCUMENTS

CN 101828878 A 9/2010
CN 103322753 A * 9/2013
CN 103393269 A * 11/2013
CN 203980759 U 12/2014
CN 105387670 A * 3/2016
CN 107523104 A * 12/2017
CN 206852220 U * 1/2018 ..... A45C 13/26
CN 208312807 U 1/2019
DE 10259328 A1 * 7/2003 ..... E05B 1/0015
DE 102008019535 A1 * 10/2009 ..... B60N 3/023
JP H0729857 Y2 * 7/1995
JP 2017072304 A 4/2017
KR 19980031198 U * 8/1998
KR 20040018745 A * 3/2004
KR 20050047258 A * 5/2005
WO WO-2009025294 A1 * 2/2009 ..... A45C 13/26
WO 2019206221 A1 10/2019

* cited by examiner

MOBILE REFRIGERATOR HAVING BUILT-IN HANDLES

TECHNICAL FIELD

The present application relates to the technical field of mobile refrigerators, and more specifically, relates to a mobile refrigerator having built-in handles.

BACKGROUND

At present, most of the handles of mobile refrigerators are convex, and the handle is connected with the refrigerator through mechanical structure. The handle has the following problems. In the process of moving, the handle will shake and generate noise, so the rotation angle of the handle can not be set, which brings inconvenience to users. In addition, the convex handle needs a larger size of the packaging carton, which is not conducive to energy conservation and environmental protection.

Technical Problem

The technical problem to be solved by the present application is to provide a mobile refrigerator having built-in handles, in which the moving handle can not shake through the spring elasticity, and the rotation angle is limited to avoid damage to the handle.

Technical Solution

The technical solution of the present application is as follows: the present application provides a mobile refrigerator having built-in handles, comprising a box and handles, wherein, side portions of the box are provided with recesses for accommodating the handles; each handle comprises a fixed base, a turnable handgrip, and springs; the fixed base is connected to the box by means of bolts; the turnable handgrip is turnably connected to the fixed base by means of the springs;

- two ends of the fixed base are provided with a first accommodation cavity and first bolt holes; the fixed base is fixed on the box by means of bolts through the first bolt holes;
- the turnable handgrip comprises a grip, a first turning member and a second turning member respectively connected to both ends of the grip; both ends of the grip are provided with second bolt holes; connecting columns are provided on top of the first turning member and the second turning member, second accommodation cavities are provided on bottom of the first turning member and the second turning member; a third bolt hole is provided on bottom of each second accommodation cavity, the grip is connected to the first turning member and the second turning member separately by means of bolts;
- the spring is sleeved on the connecting column, the connecting column and the spring are both accommodated in the first accommodation cavity, making the first turning member and the second turning member turnably connected to the fixed base separately.

Further, two ends of the grip are provided with a first recess, side wall of the second accommodation cavity is provided with a protrusion, the protrusion is locked in the first recess to prevent the grip from rotating relative to the first turning member and the second turning member.

Further, an inner limiting protrusion and a second recess are provided at lower part of the connecting column.

Further, the fixed base is further provided with outer limiting protrusions, the outer limiting protrusions corresponds to the position of the inner limiting protrusions; the first accommodation cavity is provided with limiting plates at intervals.

Further, a horizontal connection end and a vertical connection end are extended out of two ends of the spring; the horizontal connection end butts against the limiting plates, the vertical connection end is accommodated in the second recess.

Further, the grip is a plated steel pipe or a stainless steel pipe.

Beneficial Effects

The mobile refrigerator having built-in handle has the following beneficial effects: the springs are provided at the handle, and the handle is adhered to the box by means of the elasticity of the springs, and thus does shake during movement; multiple limiting plates form different intervals, the elasticities of the springs are different when the springs are in different intervals, so as to adjust the tightness of the springs, i.e., the closeness of the handle adhered to the box is adjusted; by means of the abutting of inner limiting protrusions and outer limiting protrusions, the turning angle of the handle is limited, thereby preventing the handle from being damaged due to too large turning angle.

BRIEF DESCRIPTION OF THE DRAWINGS

The present application will be further described below in conjunction with the drawings and embodiments, in the drawings.

DETAILED DESCRIPTION OF THE PREFERRED EMBODIMENT

Figure 1:
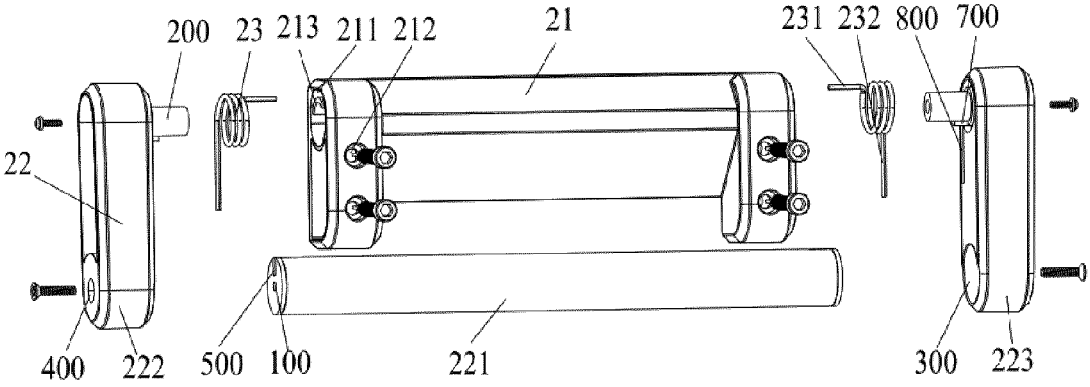
FIG. 1 is a schematic diagram of the split state of the handle of the mobile refrigerator having built-in handles of the present application.
Figure 2:
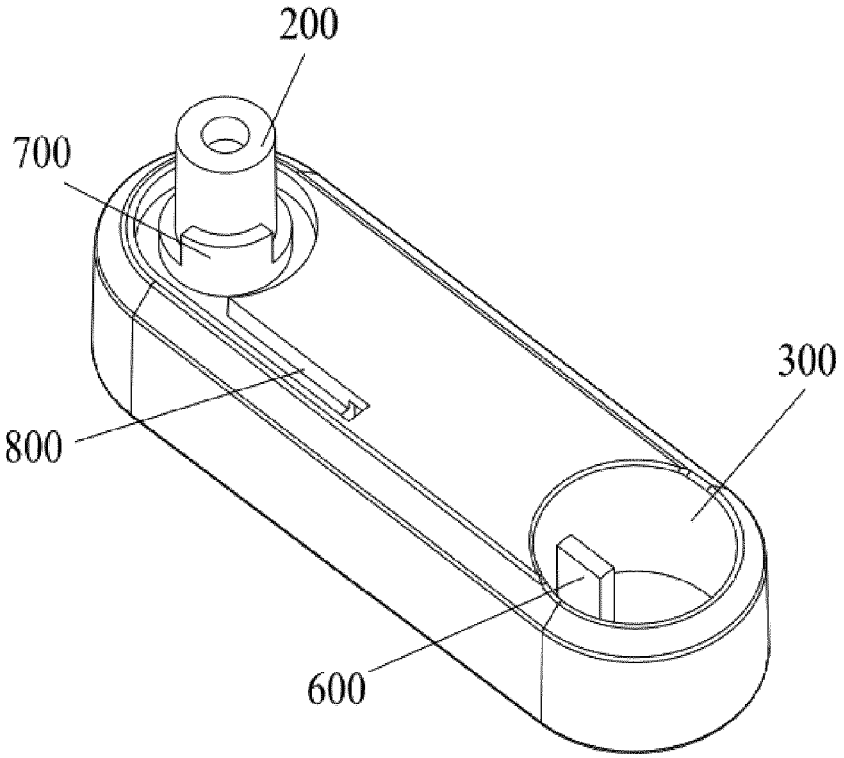
FIG. 2 is the structural diagram of the turnable handgrip of the mobile refrigerator having built-in handles of the present application.
Figure 3:
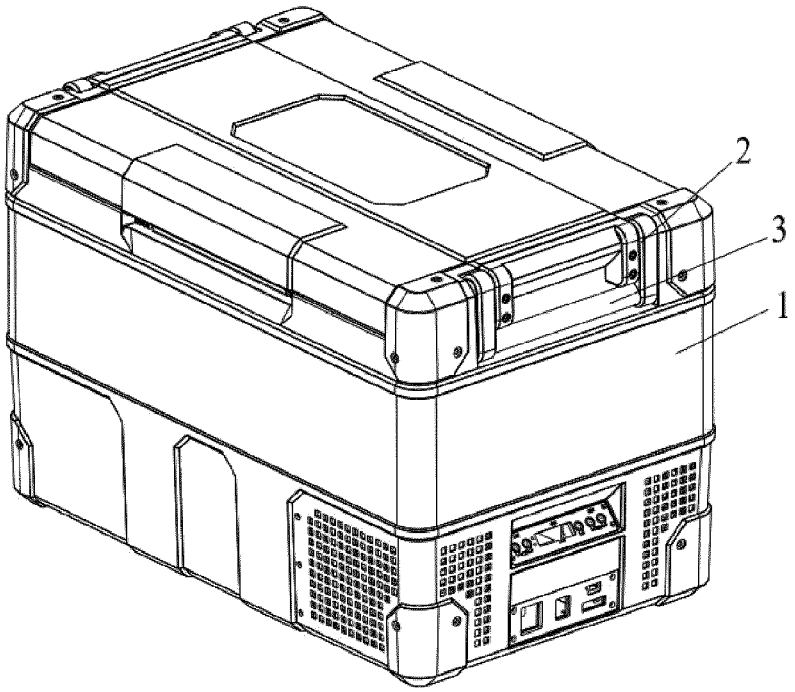
FIG. 3 is the structural diagram of the handles in normal position of the mobile refrigerator having built-in handles of the present application.
Figure 4:
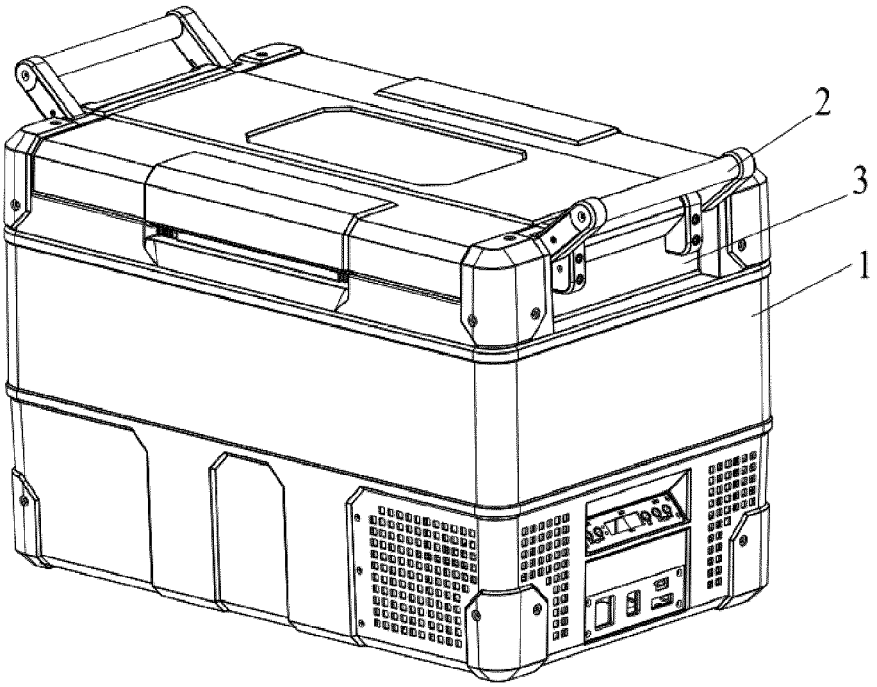
FIG. 4 is the structural diagram of the handles lifted upward of the mobile refrigerator having built-in handles of the present application.

FIGS. 1 to 4 show a preferred embodiment of the mobile refrigerator having built-in handles of the present application, which comprising a box 1 and handles 2, wherein, side portions of the box 1 are provided with recesses 3 for accommodating the handles 2; each handle 2 comprises a fixed base 21, a turnable handgrip 22, and springs 23; the fixed base 21 is connected to the box 1 by means of bolts; the turnable handgrip 22 is turnably connected to the fixed base 21 by means of the springs 23; two ends of the fixed base 21 are provided with a first accommodation cavity 211 and first bolt holes 212; the fixed base 21 is fixed on the box 1 by means of bolts through the first bolt holes 212; the turnable handgrip 22 comprises a grip 221, a first turning member 222 and a second turning member 223 respectively connected to both ends of the grip 221; both ends of the grip 221 are provided with second bolt holes 100; connecting columns 200 are provided on top of the first turning member 222 and the second turning member 223, second accommodation cavities 300 are provided on bottom of the first turning member 222 and the second turning member 223; a third bolt hole 400 is provided on bottom of each second accommodation cavity 300, the grip 221 is connected to the first turning member 222 and the second turning member 223 separately by means of bolts; the spring 23 is sleeved on the connecting column 200, the connecting column 200 and the spring 23 are both accommodated in the first accommodation cavity 211, making the first turning member 222 and the second turning member 223 turnably connected to the fixed base 21 separately. In the embodiment, the handle 2 is arranged on the left and right sides of the box 1, which is convenient for both hands to hold when moving the refrigerator. The fixed base 21 is connected with the box 1 by means of bolts, and is used to fix the turnable handgrip 22. The turnable handgrip 22 includes a grip 221, a first turning member 222 and a second turning member 223. The grip 221 is used for holding, and the turning part is rotationally connected with the fixed base 21. In order to avoid noise generated by shaking the turnable handgrip 22 and the box 1 during the moving process of the refrigerator, a spring 23 is arranged between the turnable handgrip 22 and the fixed base 21, and the elastic force of the spring 23 makes the turnable handgrip 22 close to the box 1, so as to avoid the above defects.

In the embodiment, two ends of the grip 221 are provided with a first recess 500, side wall of the second accommodation cavity 300 is provided with a protrusion 600, the protrusion 600 is locked in the first recess 500 to prevent the grip 221 from rotating relative to the first turning member 222 and the second turning member 223. The grip 221 is connected with the first turning member 222 and the second turning member 223 through bolts. In order to avoid the bolt loosening caused by the rotation of the grip 221, a mechanical connection between the protrusion 600 and the first recess 500. When the turnable handgrip 22 is rotated, the grip 221 rotates simultaneously with the first turning member 222 and the second turning member 223. The protrusion 600 may be a cuboid or other shapes, and the shape of the first recess 500 is compatible with the protrusion 600.

In the embodiment, the lower part of the connecting column 200 is provided with an inner limiting protrusions 700 and a second recess 800. The fixed base 21 is further provided with an outer limiting protrusion 213, the outer limiting protrusions 213 corresponds to the position of inner limiting protrusions 700; the first accommodation cavity 211 is provided with limiting plates at intervals. Both the inner limiting protrusions 700 and the outer limiting protrusions 213 are arc-shaped protrusion. When the connecting column 200 and the springs 23 of the first turning member 222 and the second turning member 223 are fixed in the first accommodation cavity 211, the outer limiting protrusion 213 and the inner limiting protrusion 700 are in the same plane. When the handle 2 rotates, the inner limiting protrusion 700 also rotates. When the handle 2 is rotated to abut against the outer limiting protrusion 213, the handle 2 is subject to resistance, which limits the rotation angle of the handle 2 and prevents the handle from being damaged due to excessive rotation angle.

In the embodiment, a horizontal connection end 231 and a vertical connection end 232 are extended out of two ends of the spring 23; the horizontal connection end 231 is abutted against the limiting plates, vertical connection end 232 is accommodated in the second recess 800. Multiple limiting plates are provided in the first accommodation cavity 211, intervals between different limiting plates form different limiting intervals. When the horizontal connection end 231 is placed in different limiting intervals, the twist angle is different, and the spring force is also different, so the spring force of spring 23 can be adjusted. That is, when the handle 2 is close to the box 1 when it is not operated, the elastic force should not be too large or too small. If it is too large, it needs a large force to pull up the handle 2. If the force is too small, the handle 2 can not be close to the box 1. During the movement, it will shake and make noise. It can be adjusted to the appropriate limit range according to the use condition. The second recesses 800 is used to accommodate and fix the vertical connection end 232 of the spring 23, so that the spring can be twisted to produce elastic force.

In the embodiment, the grip 221 is a plated steel pipe or a stainless steel pipe. Mobile refrigerators often encounter water when they are in use. In order to avoid wet hands from contacting the grip 221 and rusting, the material of the grip 221 is set as plated steel or stainless steel.

In the mobile refrigerator having built-in handles of the present application, the springs are provided at the handle, and the handle is adhered to the box by means of the elasticity of the springs, and thus does shake during movement; multiple limiting plates form different intervals, the elasticities of the springs are different when the springs are in different intervals, so as to adjust the tightness of the springs, i.e., the closeness of the handle adhered to the box is adjusted; by means of the abutting of inner limiting protrusions and outer limiting protrusions, the turning angle of the handle is limited, thereby preventing the handle from being damaged due to too large turning angle.

The above content is only a prefer embodiment of the present application. For ordinary technical personnel in the field, according to the idea of the present application, many changes can be made in the specific implementation mode and application scope. As long as these changes do not deviate from the concept of the present application, they belong to the protection scope of the present application.

The invention claimed is:

1. A mobile refrigerator having built-in handles, comprising:

a box and handles, wherein side portions of the box are provided with recesses for accommodating the handles; each handle comprises a fixed base, a turnable handgrip, and two springs; the fixed base is connected to the box by bolts; the turnable handgrip is turnably connected to the fixed base by the two springs;

two ends of the fixed base are provided with a first accommodation cavity and first bolt holes; the fixed base is fixed on the box by bolts through the first bolt holes;

the turnable handgrip comprises a grip, a first turning member and a second turning member, respectively, connected to both ends of the grip; both ends of the grip are provided with second bolt holes; connecting columns are provided on top of the first turning member and the second turning member, second accommodation cavities are provided on bottom of the first turning member and the second turning member; a third bolt hole is provided on bottom of each second accommodation cavity, the grip is connected to the first turning member and the second turning member separately by bolts;

each spring is sleeved on the respective connecting column that face each other, the connecting column and the spring are both accommodated in the first accommodation cavity, making the first turning member and the second turning member turnably connected to the fixed base separately, wherein each connecting column includes an inner limiting protrusion extending upward from a lower portion thereof and a recess for receiving the spring; wherein the recess of each connecting column has a first recess portion that is configured to receive a coil portion of the spring and a second recess portion that is configured to receive an extended portion of the spring; wherein the first recess portion and the second recess portion are a unitary member; wherein the first recess portion surrounds the connecting column and the second recess portion extends parallel to a planar surface of the first turning member and the second turning member.

2. The mobile refrigerator having built-in handles according to claim 1, wherein the second accommodation cavity includes a protrusion within a side wall of the second accommodation cavity, the protrusion having a shape that corresponds to a shape of a first recess of the grip to prevent the grip from rotating relative to the first turning member and the second turning member.

3. The mobile refrigerator having built-in handles according to claim 2, wherein the protrusion is cuboid shaped.

4. The mobile refrigerator having built-in handles according to claim 3, wherein the first recess is cuboid shaped.

5. The mobile refrigerator having built-in handles according to claim 1, wherein a horizontal connection end and a vertical connection end extend out of two ends of the spring; the horizontal connection end abuts against limiting plates, the vertical connection end is accommodated in a second recess.

6. The mobile refrigerator having built-in handles according to claim 1, wherein the grip is a plated steel pipe or a stainless steel pipe.

7. A mobile refrigerator having built-in handles, comprising:

a box and handles, wherein side portions of the box are provided with recesses for accommodating the handles each handle comprises a fixed base, a turnable handgrip, and two springs; the fixed base is connected to the box by bolts; the turnable handgrip is turnably connected to the fixed base by the two springs;

two ends of the fixed base are provided with a first accommodation cavity and first bolt holes; the fixed base is fixed on the box by bolts through the first bolt holes;

the turnable handgrip comprises a grip, a first turning member and a second turning member respectively connected to both ends of the grip; both ends of the grip are provided with second bolt holes; connecting columns are provided on top of the first turning member and the second turning member, second accommodation cavities are provided on bottom of the first turning member and the second turning member; a third bolt hole is provided on bottom of each second accommodation cavity, the grip is connected to the first turning member and the second turning member separately by bolts;

each spring is sleeved on the connecting column that face each other, the connecting column and the spring are both accommodated in the first accommodation cavity, making the first turning member and the second turning member turnably connected to the fixed base separately;

wherein each of the connecting column of the first turning member and the second turning member is provided with an inner limiting protrusion and a second recess at lower part of the connecting column to correspond to a position of an outer limiting protrusion provided on the fixed base; and wherein the inner limiting protrusion extends circumferentially upward from a lower portion of the connecting columns; wherein the inner limiting protrusion is configured to engage with the outer limiting protrusion formed in the first accommodation cavity, the outer limiting protrusion and the inner limiting protrusion are arc-shaped protrusions that engage with each other such that:

when the connecting column and the spring of the first turning member and the second turning member are fixed in the first accommodation cavity, the outer limiting protrusion and the inner limiting protrusion are in a same plane, and when the handle is rotated to abut against the outer limiting protrusion, the handle is subject to resistance so as to limit rotational angle of the handle and prevent the handle from damage due to excessive rotational angle.

8. The mobile refrigerator having built-in handles according to claim 7, wherein the second accommodation cavity includes a protrusion within a side wall of the second accommodation cavity, the protrusion having a shape that corresponds to a shape of a first recess of the grip to prevent the grip from rotating relative to the first turning member and the second turning member.

9. The mobile refrigerator having built-in handles according to claim 8, wherein the protrusion is cuboid shaped.

10. The mobile refrigerator having built-in handles according to claim 9, wherein the first recess is cuboid shaped.

11. The mobile refrigerator having built-in handles according to claim 7, wherein the grip is a plated steel pipe or a stainless steel pipe.

12. The mobile refrigerator having built-in handles according to claim 7, wherein the inner limiting protrusion has a first arc-shape and the outer limiting protrusion has a second arc-shape that corresponds to the shape of the inner limiting protrusion.

* * * * *